US009515390B1

(12) United States Patent
Feng et al.

(10) Patent No.: US 9,515,390 B1
(45) Date of Patent: Dec. 6, 2016

(54) DISCRETE PHASED ELECTROMAGNETIC REFLECTOR BASED ON TWO-STATE ELEMENTS

(71) Applicants: Simin Feng, Waldorf, MD (US); Kevin A. Boulais, La Plata, MD (US); Frank L. Wallace, Fredericksburg, VA (US); Blaise L. Corbett, King George, VA (US); Victor H. Gehman, Jr., Dahlgren, VA (US)

(72) Inventors: Simin Feng, Waldorf, MD (US); Kevin A. Boulais, La Plata, MD (US); Frank L. Wallace, Fredericksburg, VA (US); Blaise L. Corbett, King George, VA (US); Victor H. Gehman, Jr., Dahlgren, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 28 days.

(21) Appl. No.: 14/737,283

(22) Filed: Jun. 11, 2015

(51) Int. Cl.
*H01Q 19/10* (2006.01)
*H01Q 15/14* (2006.01)

(52) U.S. Cl.
CPC ..... *H01Q 15/148* (2013.01); *H01Q 19/10* (2013.01)

(58) Field of Classification Search
CPC ..... H01Q 15/148
USPC ..... 343/837
See application file for complete search history.

(56) References Cited

U.S. PATENT DOCUMENTS

| | | | | |
|---|---|---|---|---|
| 6,396,449 | B1 | 5/2002 | Osterhues et al. | 343/754 |
| 6,806,792 | B2 | 10/2004 | Penn | 333/164 |
| 7,315,225 | B2 | 1/2008 | Borysenko | 333/164 |
| 7,907,100 | B2 | 3/2011 | Mortazawi et al. | 343/853 |
| 7,969,359 | B2 | 6/2011 | Krishnaswamy et al. | 342/372 |
| 8,009,114 | B2 | 8/2011 | Hauhe et al. | 343/754 |
| 9,099,775 | B2 * | 8/2015 | Dussopt | |
| 2001/0019314 | A1 * | 9/2001 | Quellec | G01S 13/426 342/74 |

OTHER PUBLICATIONS

S. Feng: "Loss-induced Omnidirectionally Bending to the Normal in Σ-near-Zero Metamaterials", *Phys Rev Lett*108 193904,(2012). http://journals.aps.org/prl/pdf/10.1103/PhysRevLett.108.193904.

S. Feng: "Graphical retrieval method for orthorhombic anisotropic materials", *Optics Express*18(16) 17009-19 (2010). https://www.osapublishing.org/DirectPDFAccess/3300E92E-EADB-F57B-963567826C47285B_204093/oe-18-16-17009.pdf http://arxiv.org/pdf/1007.3938v1.pdf http://www.dtic.mil/dtic/tr/fulltext/u2/a526572.pdf.

B. Zhu et al.: "Polarization modulation by tunable electromagnetic metamaterial reflector/absorber" (2010). http://arxiv.org/ftp/arxiv/papers/1010/1010.4378.pdf.

I.-Y Tarn et al.: "A Novel Pattern Diversity Reflector Antenna Using Reconfigurable Frequency Selective Reflectors", *IEEE Trans on Antennas and Propagation*57(10) (2009). http://ir.nctu.edu.tw/bitstream/11536/6594/1/000270723600010.pdf.

* cited by examiner

*Primary Examiner* — Peguy Jean Pierre
(74) *Attorney, Agent, or Firm* — Oscar A. Towler, III Esq.

(57) ABSTRACT

An electromagnetic reflector for reflecting an electromagnetic signal is provided based on meta-surface phase control using photo-capacitive materials, varactors or other tuning means. The shape of the metamaterial unit cell enhances the resonance and phase shift. The reflector includes first and second cells having respective first and second phase states, along with a switch for selecting between the first and second cells.

3 Claims, 9 Drawing Sheets

| Case | State of Each Element | Resulting Value 200 | Net Phase Shift of Reflected Signal |
|---|---|---|---|
| 1 | $\varphi_1 = 0$ and $\varphi_2 = 0$ | $\phi = 2\sin(\omega t)$ | 0 |
| 2 | $\varphi_1 = 0$ and $\varphi_2 = \psi$ | $\phi = 2\cos(\frac{\psi}{2})\sin(\omega t + \frac{\psi}{2})$ | $\frac{\psi}{2}$ |
| 3 | $\varphi_1 = \psi$ and $\varphi_2 = \psi$ | $\phi = 2\sin(\psi + \omega t)$ | $\psi$ |

Fig. 2

| Amplitude State | Phase State | Resulting Phase (deg) 300 |
|---|---|---|
| [1 1] | [0 0] | 0 |
| [1 1] | [0 90] | 45 |
| [1 1] | [90 90] | 90 |
| [0.5 1] | [0 90] | 63.4 |
| [1 0.5] | [0 90] | 26.6 |

Fig. 3

DISCRETE PHASED ELECTROMAGNETIC REFLECTOR BASED ON TWO-STATE ELEMENTS

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to electromagnetic radiation reflectors. In particular, the invention relates to signal reflectors to redirect and/or reshape electromagnetic radiation.

Radiation reflectors include reflect-arrays, which are known to those skilled in the art of antenna designs as useful for reflecting an electromagnetic wave at various angles by controlling the phase of the elements that compose the array.

A phased array can be used to control electromagnetic radiation. By controlling the phase of each element within the array, a narrow electromagnetic beam can be formed. By dynamically changing the phase in a way known to those skilled in the art of antenna design, the beam can be steered, as reported by A. J. Fenn et al., "The Development of Phased-Array Radar Technology", *LINCOLN Laboratory Journal,* 12 321-340 (2000), available at https://www.ll.mit-edu/publications/journal/pdf/vol12_no2/12_2devphasedar-ray.pdf.

Reflect-arrays are similar to phased arrays but the elements in the array produce no radiation of their own. Instead, each element is a reflector that reflects a small portion of incident radiation. Often, the elements are designed to be resonant at a given frequency or over a range of frequencies. By controlling the resonance, the phase of the reflected signal can be dynamically controlled into different directions as reported by D. G. Berry et al., "The Reflectarray Antenna", *IEEE Transactions on Antennas and Propagation,* 11 645-651 (1963).

The transition between two phases in a reflect-array often occurs over a very narrow range of control parameters. Precise control of the phase of each element can be difficult in relation to the others in order to achieve precise beam steering. Further, due to material losses and resonant component losses, the amplitude of the reflected signal can be dramatically reduced at resonance, which is often an undesirable effect.

SUMMARY

Conventional electromagnetic reflectors yield disadvantages addressed by various exemplary embodiments of the present invention. Various exemplary embodiments provide a method and system for controlling the phase (and amplitude) of a reflect-array at any angle while maintaining high reflected amplitude of the signal. In particular, the proposed two-stage elements provide a simple solution and are easy to implement. Other various embodiments alternatively or additionally provide for a broader range of phase control. Unlike conventional reflector array where each element is separated by about half wavelength, various reflector array embodiments contain a set of panels, each panel has several super-cells and each super-cell has several unit cells. This high resolution also enhances control of the beam in a more precise way than traditional array reflectors.

Various exemplary embodiments provide optical control without the electromagnetic interference effect. These can be performed in conjunction with other methods for control. These and other objects are achieved by the invention, embodiments of which comprise a system and method for controlling the phase shift of a reflected electromagnetic signal in a reflect-array by employing a unit cell comprising an element having multiple phase states. Additional aspects and/or advantages of the invention will be set forth in part in the description which follows and, in part, will be obvious from the description, or may be learned by practice of the invention.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which:

FIG. 2 is a tabular view of phase responses for various states;

FIG. 3 is a tabular view of amplitude and phase responses;

DETAILED DESCRIPTION

Figure 1A:
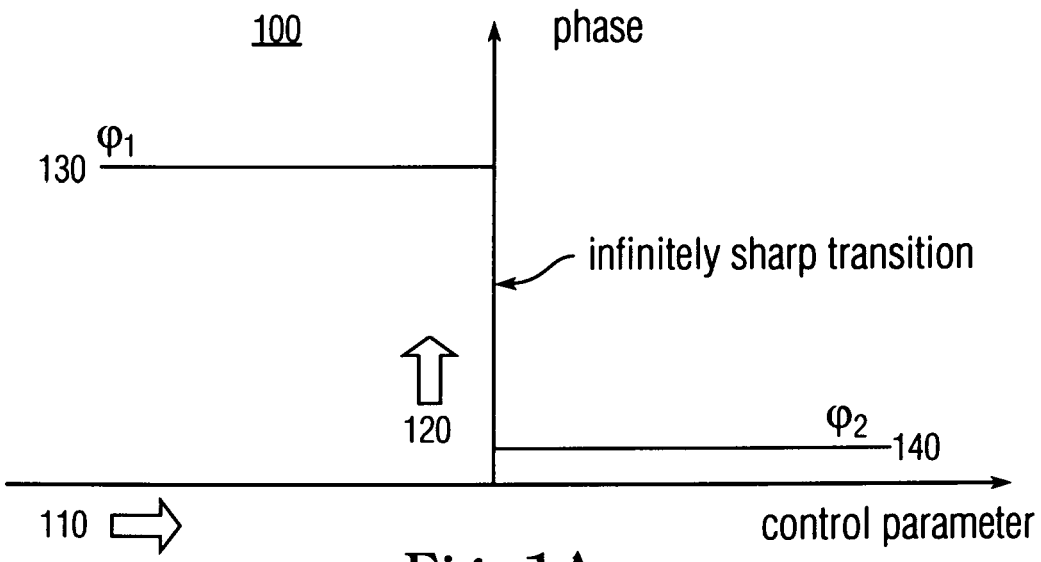
FIGS. 1A and 1B are plot views of idealized step function phase response.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

In accordance with a presently preferred embodiment of the present invention, the components, process steps, and/or data structures may be implemented using various types of operating systems, computing platforms, computer programs, and/or general purpose machines. In addition, those of ordinary skill in the art will readily recognize that devices of a less general purpose nature, such as hardwired devices, or the like, may also be used without departing from the scope and spirit of the inventive concepts disclosed herewith. General purpose machines include devices that execute instruction code. A hardwired device may constitute an application specific integrated circuit (ASIC) or a field programmable gate array (FPGA) or other related component.

Reference will now be made in detail to the present embodiments of the present invention, examples of which are illustrated in the accompanying drawings, wherein like reference numerals refer to the like elements throughout. The embodiments are described below in order to explain the present invention by referring to the figures. The embodiments are predicated on the discovery that, in reflect-arrays, the phase shift of the reflected wave may be controlled at any particular angle by employing elements having multiple phase states.

More particularly, the phase of the reflected wave has discrete values depending on the number of elements in the array that can be controlled in a more stable way. Various embodiments provide a method and a system for reflecting an electromagnetic wave with a phase change from that of normal metallic or dielectric materials.

The phase of the reflected wave can be any number of discrete steps in phase dependent on the number of elements in the reflect-array. A principal advantage of exemplary embodiments is that the phase change can be accomplished using any unit-cell structure that has two states. Another advantage is that phase resolution and dynamic range can be independently controlled. For example, in a simple linear array, a ten-element array can reflect the electromagnetic wave with any one of eleven phase values in one particular direction (normal to the array for example). For elements that have two states of phase shift, given by phases $\phi_1$ and $\phi_2$, then the eleven phase values will lie between $\phi_1$ and $\phi_2$.

Exemplary embodiments enable the control of the phase (and amplitude) of a reflect-array at any angle. For clarity, the angle can be assumed to be normal to the array in the following description. Each unit-cell in the array can be assumed to have two phases. For example, each unit-cell can be phase $\phi_1$ or phase $\phi_2$. The continuous phase change between $\phi_1$ and $\phi_2$ can be assumed to be infinitely sharp effectively for clarity.

Figure 1B:
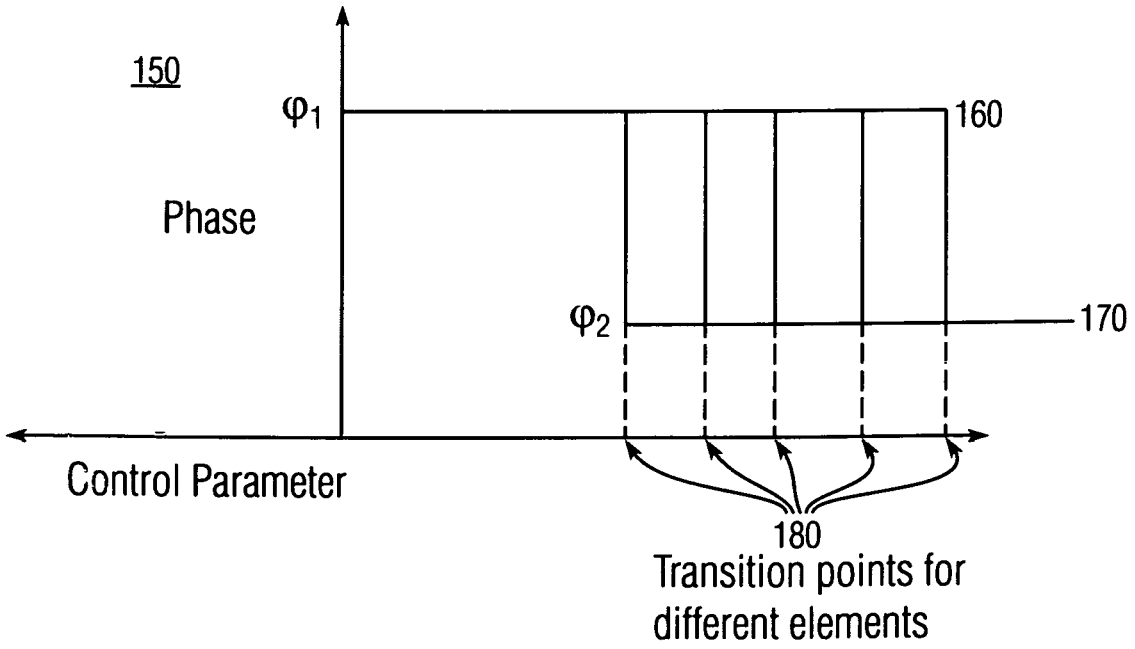

FIG. 1A shows a diagram view 100 of the step function phase response of a two-phase unit-cell. A control parameter represents the abscissa 110 and phase denotes the ordinate 120. Values for the first phase 130 and the second phase 140 are plotted as different constants, with the phase transition at a specified value of the control variable assumed to be infinitely sharp for clarity. FIG. 1B shows a diagram view 150 of the step function phase response with transition points for a group of unit-cells and the same abscissa 110 and ordinate 120. Values for the first phase 160 and the second phase 170 are plotted as different constants, with the transitions 180 being responsive to different elements.

For unique transition points for each element, either by design or caused by general manufacturing tolerances, then each element can change states at a different setting of the control parameter. The phase shift $\psi_n$ for each element n represents one of two states for any of the N elements. Depending on how many of the N elements are in state $\phi_1$ or in state $\phi_2$ then the final wave will have any phase between $\phi_1$ and $\phi_2$ with N+1 discrete steps. For example, one can assume that a simple two-element system has a total of three phase states.

A plurality of elements can reflect many discrete phases. With N elements, one can achieve N+1 discrete phases. Depending on the configuration of phase distribution among the elements, either linear or random phase patterns of the total field can be generated. For example, for six elements with ±90° of two phase states, a linear phase chirp can be generated if the distribution pattern of each step is given by the array:

+90+90+90+90+90+90
−90+90+90+90+90+90
−90−90+90+90+90+90
−90−90−90+90+90+90
−90−90−90−90+90+90
−90−90−90−90−90+90
−90−90−90−90−90−90

Possible control elements include, but are not limited to, photo-capacitance chips with different capacitance and conductivity controlled by infrared (IR) light intensity, as well as piezoelectric materials and carbon nanotubes (CNT). Other control elements exist and this invention should not be restricted by any particular control method. For example, some control methods might use electric control, or thermal control, piezo control, liquid crystal control, etc. instead of optical control. If a wavelet is reflected from each of n elements, then the final wave will have a net phase Φ of approximately:

$$\Phi=\Sigma_{n=1}^{N}\sin(\psi_n+\omega t), \tag{1}$$

where n denotes an element, N is the total number of elements, $\psi_n$ is the phase shift of the element n, ω is angular frequency and t is time.

For a wavelet reflected from each of n elements, the final wave has a net phase of approximately eqn. (1) where $\psi_n$ represents one of two states for any of the N elements. Depending on how many of the N elements are in state $\phi_1$ or in state $\phi_2$, the final wave has any phase between $\phi_1$ and $\phi_2$ with N+1 discrete steps. For example, a simple two-element system has a total of three phase states. Table 1 in FIG. 2 shows a tabular listing 200 with particular states and resulting values, together with their resulting phase shift. Table 2 in FIG. 3 shows a tabular listing 300 with amplitudes and phase states that yield resulting phase shifts. In particular, the tabular listing 300 in Table 2 summarizes an example with two elements, two phase states (0° and 90°) and two amplitude states (0.5 and 1).

The exemplary process can be applied to military fields as well as in civilian; e.g., transmission of radiation with controlled direction, such as beam steering, for nonmilitary use from radio frequency (RF) to infrared (IR), and thus would be of great interest for maritime and aerial navigation, and for weather radars. An advantage of various exemplary embodiments is that the phase can be controlled with simple two-stage elements and that the control can be accomplished without loss of amplitude of the reflected wave.

Phase resolution depends on the number of elements while dynamic range depends on the phase difference of the two states. Therefore, the resolution and the dynamic range can be independently controlled. A side lobe will exist because the system represents a two-element reflect-array where each element has different phases and amplitudes that can be controlled through, but not limited to, photocapacitors with different light intensities.

Various phase pattern can also be generated if each element is controlled to acquire a phase of either ±90° (or ±π/2 radians). Upon implementation, above phase should be added into propagation phase of electromagnetic wave through Huygens-Fresnel Principle:

$$E(r)=\frac{1}{i\lambda}\int\int_{\Sigma}E(r')\frac{\exp(ik|r-r'|)}{|r-r'|}\cos\theta ds' \tag{2}$$

where E is the electric field, Σ denotes the surface of the reflector array, λ is the wavelength of free space, $k=2\pi/\lambda$ is the wave-number of free space, θ is the polar angle between the surface normal and the observation vector r connecting the observation point to the integration vector r' on the surface Σ, and | . . . | represents the absolute value of an argument. The surface integration includes the areas of two-state elements and the spacing in between where a π phase shift is assumed due to perfect electric conductor backplane.

Figure 4A:
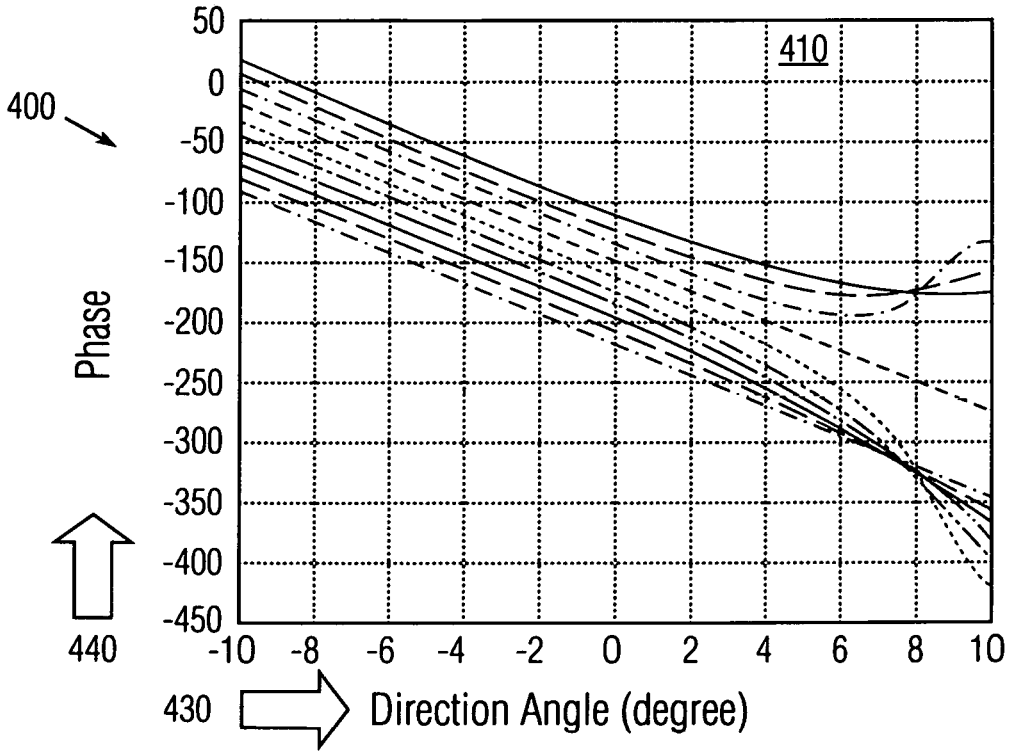
FIGS. 4A and 4B are plot views of phase responses over a range of direction angle values.
Figure 4B:
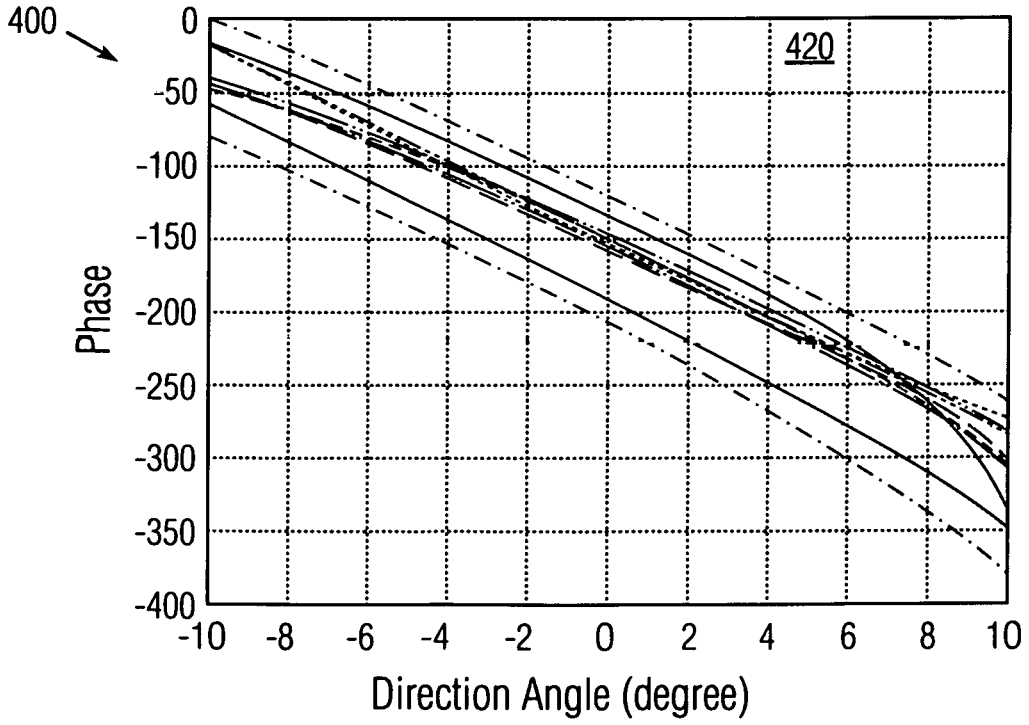

FIGS. 4A and 4B shows plot views 400 of phases of the total electromagnetic field in far field reflected from a one-dimensional (1-D) reflector array of twelve two-state elements, assume the input electromagnetic field has a linear chirp of 5° at each step. FIG. 4A identifies the 1-D plot 410 absent phase modulation. FIG. 4B identifies the plot 420 with phase modulation. Direction angle denotes the abscissa 430 and phase indicates the ordinate 440 for both plots 410 and 420.

Figure 5A:
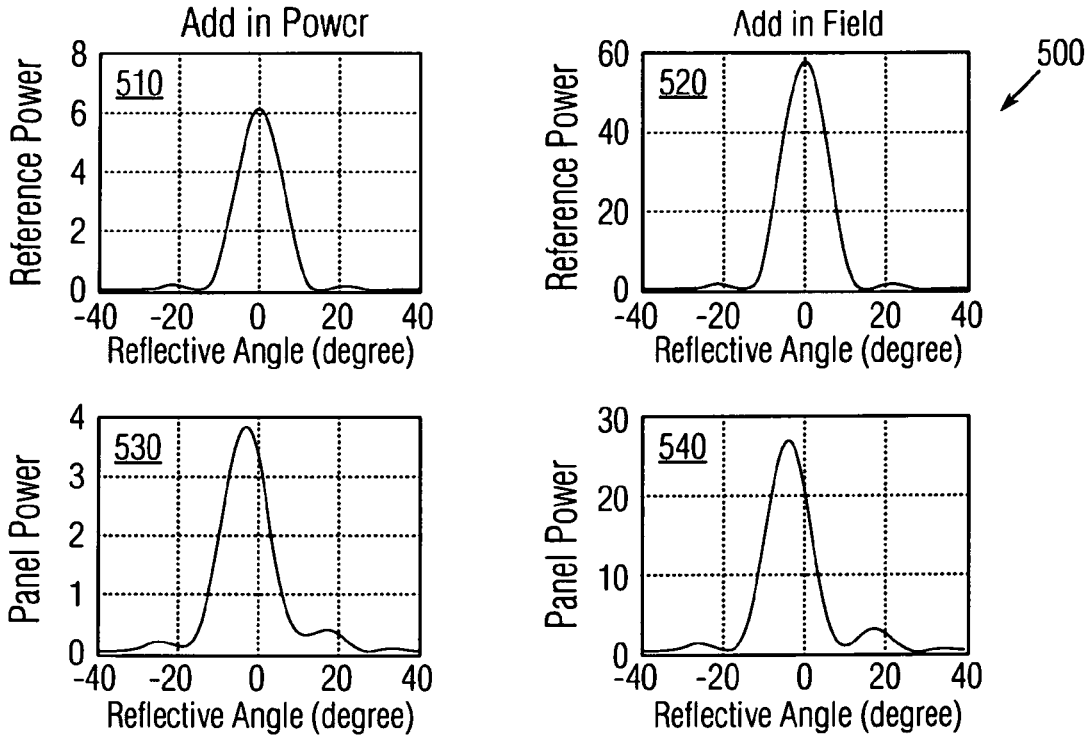
FIGS. 5A and 5B are plot views of power responses to reflection angle.
Figure 5B:
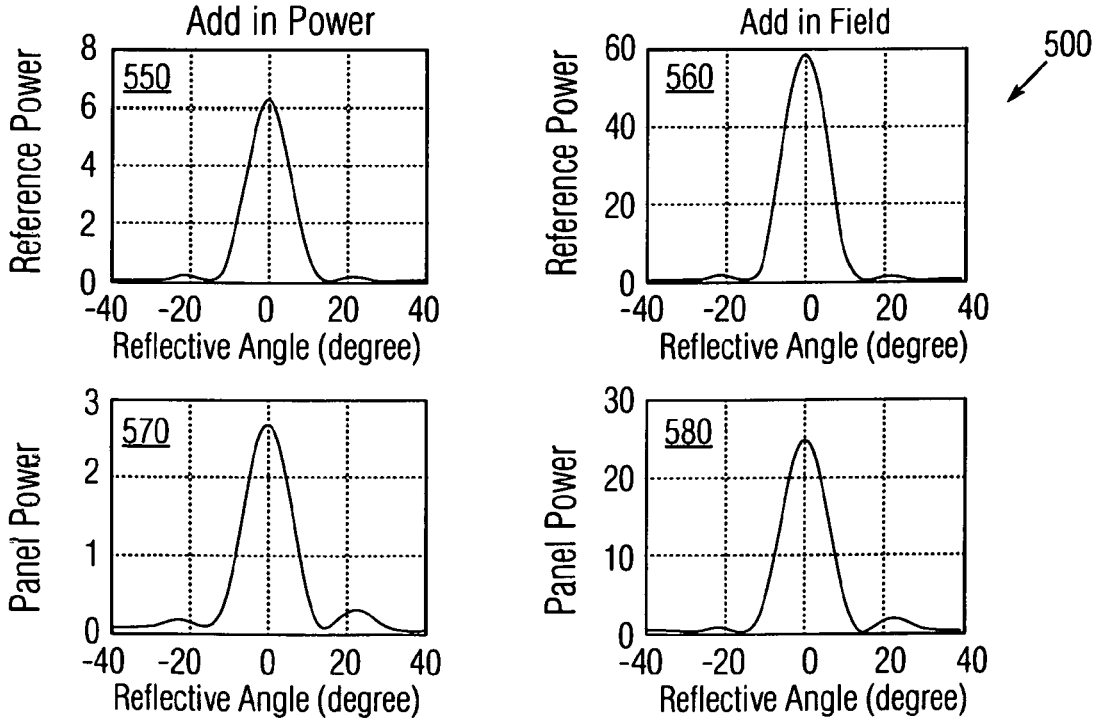

Far field power corresponding to views 400 are respectively shown in FIGS. 5A and 5B in plot views 500. Power, whether reference or panel, is shown as a function of reflection angle in degrees. Without phase modulation, plots 510 and 520 provide reference power under add-in-power and add-in-field, respectively. Note that add-in-power refers to the total power in the far field is obtained by adding radiation power of the individual element, and the add-in-field denotes the total power in the far field is obtained by adding radiation field of the individual element and then squaring it.

Plots 530 and 540 show provide panel power respectively under add-in-power and add-in-field, the peaks being off-set from null reflection angle. For phase modulation, plots 550 and 560 provide reference power under add-in-power and add-in-field, respectively; while plots 570 and 580 show panel power under add-in-power and add-in-field, respectively. As a comparison, reflection from the same size panel without phase modulation is shown in the panels. Total power decreases about 50% due to phase modulation.

Figure 6A:
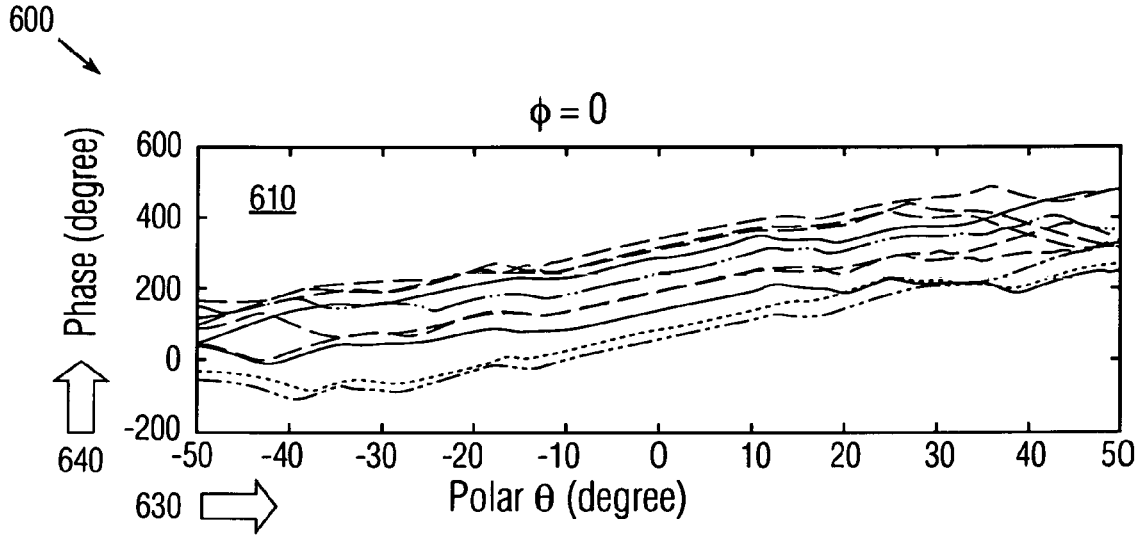
FIGS. 6A and 6B are plot views of phase responses to polar and azimuthal angles.
Figure 6B:
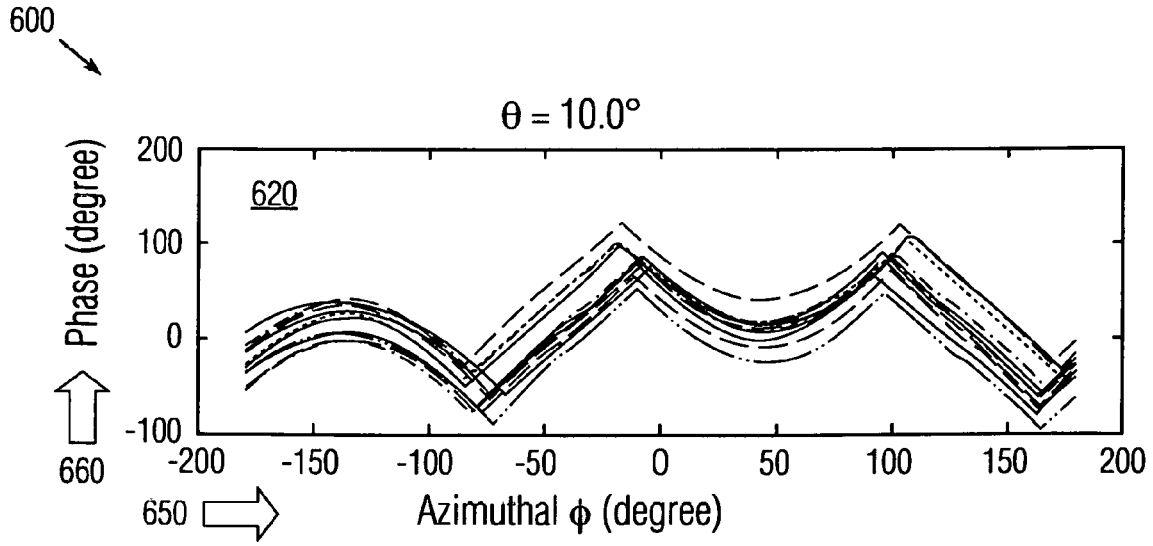

FIGS. 6A and 6B show plot views 600, depicting the phase of S-band electromagnetic waves (3±1 GHz) having wavelengths of 7.5 cm to 15 cm in far field reflected from a two-dimensional (2-D) reflector array of 12×24 two-state (±90° or ±π/2) elements. FIG. 6A provides plot view 610 for phase at zero azimuth angle. The different lines correspond to different sets of initial phases. FIG. 6B provides plot view 620 for phase at 10° polar angle.

The phase variation is caused by interference among different radiation elements. For view 610, the polar angle denotes the abscissa 630 and phase identifies the ordinate 640. For view 620, the azimuth angle denotes the abscissa 650 and phase indicates the ordinate 660. Without loss of generality, the size of each element is assumed to be 20×10 mm and spacing 12 mm and 6 mm in x and y direction, respectively.

Figure 7:
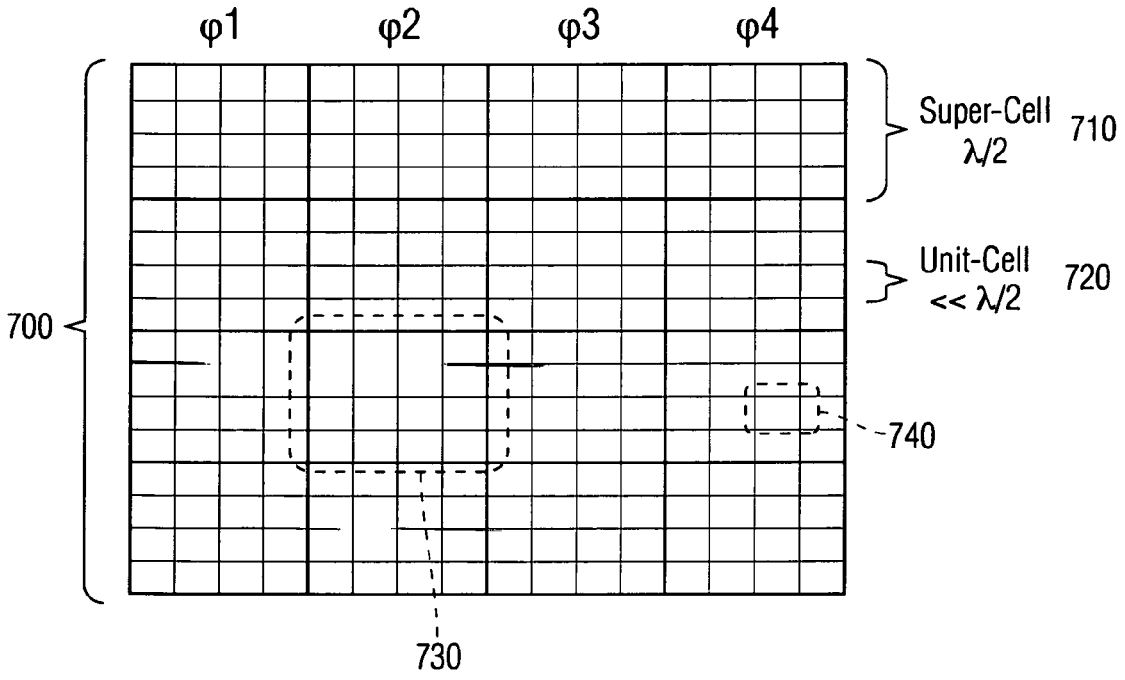
FIG. 7 is a grid view of wavelength-scale cells.

FIG. 7 shows a grid view 700 of cell arrays. Super-cells 710 have sides that measure a half-wavelength, whereas unit cells 720 are subdivided into side lengths much less than a half-wavelength. For view 700, a phased-array reflector where the elements are called "super-cells" 710. The periodicity of each super-cell is λ/2, which is typical of a phased-array system (but not limiting). In the configuration illustrated, each super-cell 710 as a cell array 730 is formed of a matrix of unit-cells 720 denoting a unit area 740. Each unit-cell 720 is a two-state phase system that can have phase state $\phi_1$ or $\phi_2$.

As described, the number of cells in either state can be adjusted, and the net reflected wave from the super-cell 710 will be of some intermediate phase between $\phi_1$ and $\phi_2$. For example, for all unit-cells 720 being in first state $\phi_1$, then the super-cell 710 reflects an electromagnetic wave with phase $\phi_1$. Also, for half the unit-cells being in state $\phi_1$ and half in state $\phi_2$, the super-cell 710 reflects an electromagnetic wave with a phase of $(\phi_1+\phi_2)/2$ assuming they both have the same amplitude.

Although the wavelength of 10 cm is used in the described simulations, applications are not limited to the S-band (3±1 GHz) in the spectrum. The methodology of exemplary embodiments can be applied to any spectrum range of electromagnetic wave. The phase Φ can be adjusted by:

$$\Phi=\Sigma_{n=1}^{N}A_n \sin(\psi_n+\omega t), \tag{3}$$

where N is the number of elements, $A_n$ is amplitude of element n, $\psi_n$ is the phase shift of element n. Thus, if each element can also control its amplitude among two or more states, then eqn. (1) transitions to eqn. (3). An example of this is shown in view 300 (Table 3) with amplitude states [0.5, 1] and [1, 0.5] and their resulting phase shifts of the total field in the far field.

Super Cells can be Used to Overcome Loss at Resonance:

Conventional reflect-array schemes suffer from amplitude loss at the resonant frequency for which they were designed as shown in views 600. The worst case amplitude loss is at resonance where the phase shift is approximately half way between $\phi_1$ and $\phi_2$. Thus, to get a strong reflectance between either $\phi_1$ or $\phi_2$ is generally thought difficult to achieve.

Figure 8B:
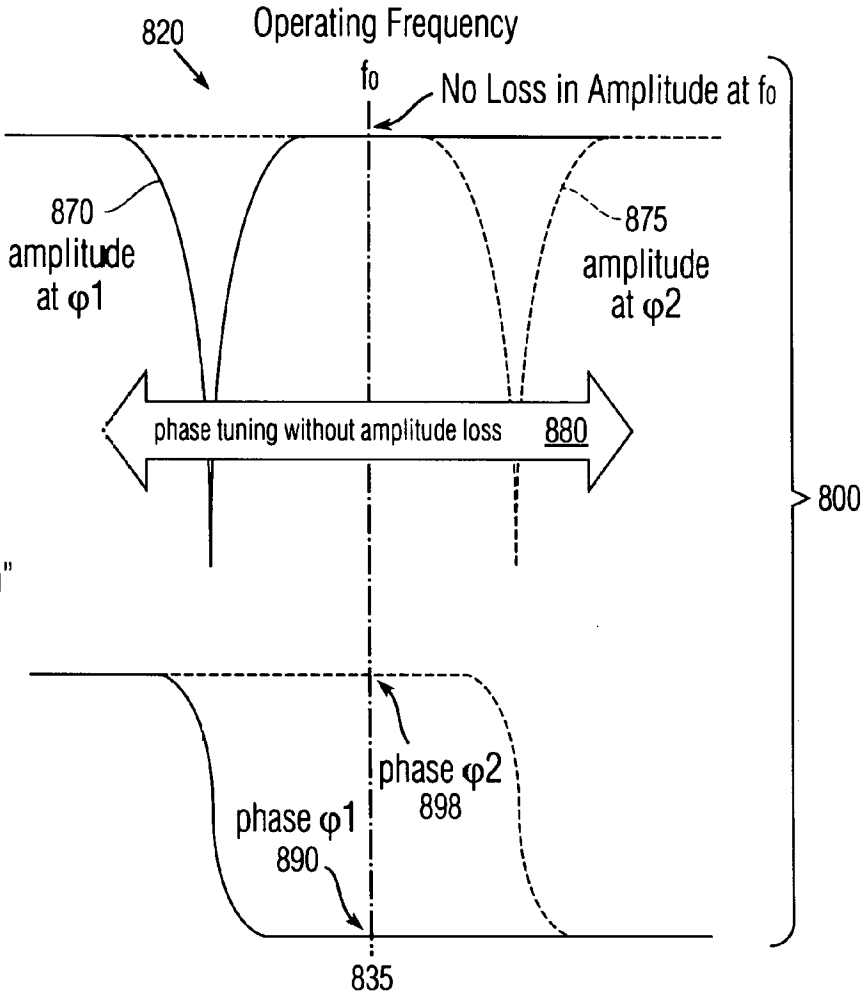
FIGS. 8A and 8B are phase amplitude responses to frequency.
Figure 8A:
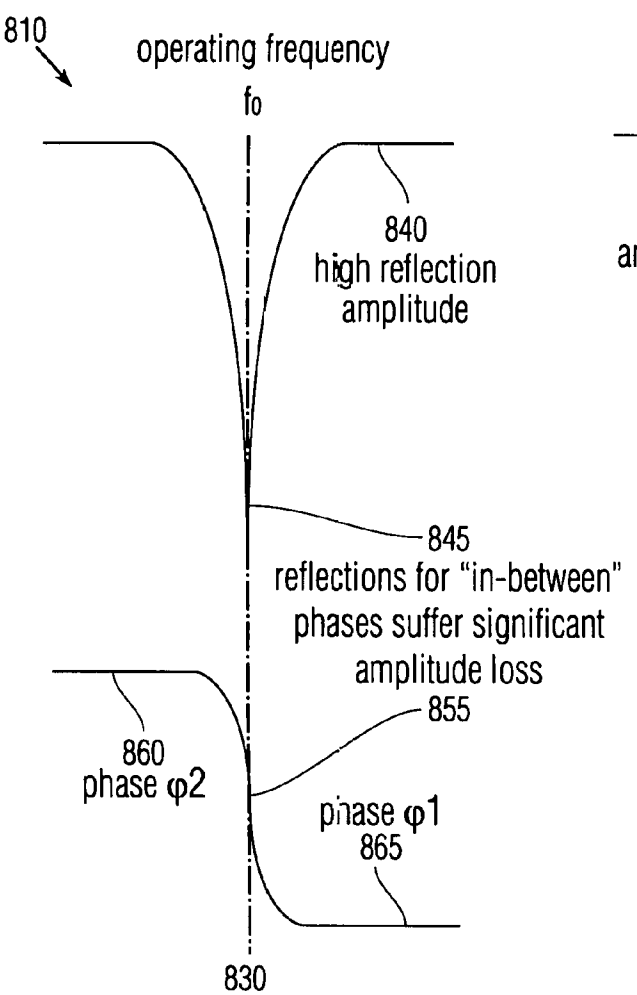

FIGS. 8A and 8B show plot views 800 for amplitude loss at specified frequencies. FIG. 8A provides reflected phase shift and amplitude in view 810 with loss at the operating frequency $f_0$ 830. FIG. 8B illustrates such phase shift and reflected amplitude loss in view 820 at frequencies adjacent to but not at the operating frequency $f_0$ 835. The response shows a high amplitude plateau 840, and a minimal cusp 845 at the operating frequency $f_0$.

The phase transition 855 at frequency $f_0$ marks the interface between the first phase $\phi_1$ 850 and the second phase $\phi_2$ 860. Reflections between phases denote amplitude loss, as noted by the cusp 845 and corresponding phase transition 855. In view 820, the amplitudes show substantial decrease at cusps 870 and 875 for the first and second phases, respectively, showing phase tuning without amplitude loss 880 across a wide frequency band. The transitions correspond to the cusps for the first phase 890 and the second phase 895, respectively. This improves noise margin at intermediate states.

A reflected wave from a super-cell 710 of a phased-array reflector can incorporate any phase between $\phi_1$ and $\phi_2$ by adjusting the number of unit-cells 720 in either state. Because each unit-cell 720 operates at a resonance from the desired operational frequency, there is no loss in amplitude. One can imagine a super-cell 710 made from two unit-cells 720. To reflect an electromagnetic wave with an intermediate phase shift, the first unit-cell 720 would operate at a frequency lower than operating frequency $f_0$ and the second unit-cell 720 would operate at a frequency higher than $f_0$.

The phase from the electromagnetic wave reflected from the super-cell 710 would have a net phase of $(\phi_1+\phi_2)/2$ at $f_0$. Similarly, if both unit-cells 720 were in state $\phi_1$, then the super-cell 710 would reflect a phase of $\phi_1$ (and similarly for $\phi_2$) at $f_0$. A higher number of unit-cells 720 within a super-cell 710 produces a higher number of net reflected phases without amplitude loss at $f_0$.

For example, the 16 unit-cells 720 within each super-cell 710 in the configuration of view 700 can produce up to seventeen discrete phase values. In fact, for n unit-cells 720 within a super-cell 710, one can derive n+1 unique phase values from the electromagnetic wave reflected from a super-cell 710. Because each super-cell 710 can then have its own phase value, a phased-array reflector is then possible using the exemplary method. Thus, a phased-array reflector could not be possible by using the reflect-array concept.

The phased-array reflector requires each emitter in the array to be capable of a continuum of phase shift values across the array in order to produce a well-defined beam at a desired angle of reflectance. As an example in practice, a two-unit cell system could have states {0,0}, {0,1}, {1,0} and {1,1}. States {0,1} and {1,0} are assumed to be degenerate and to produce the same phase shift. In practice, there might be small variations due to the physical displacement of the two unit cells that would be considered in actual design.

Figure 9:
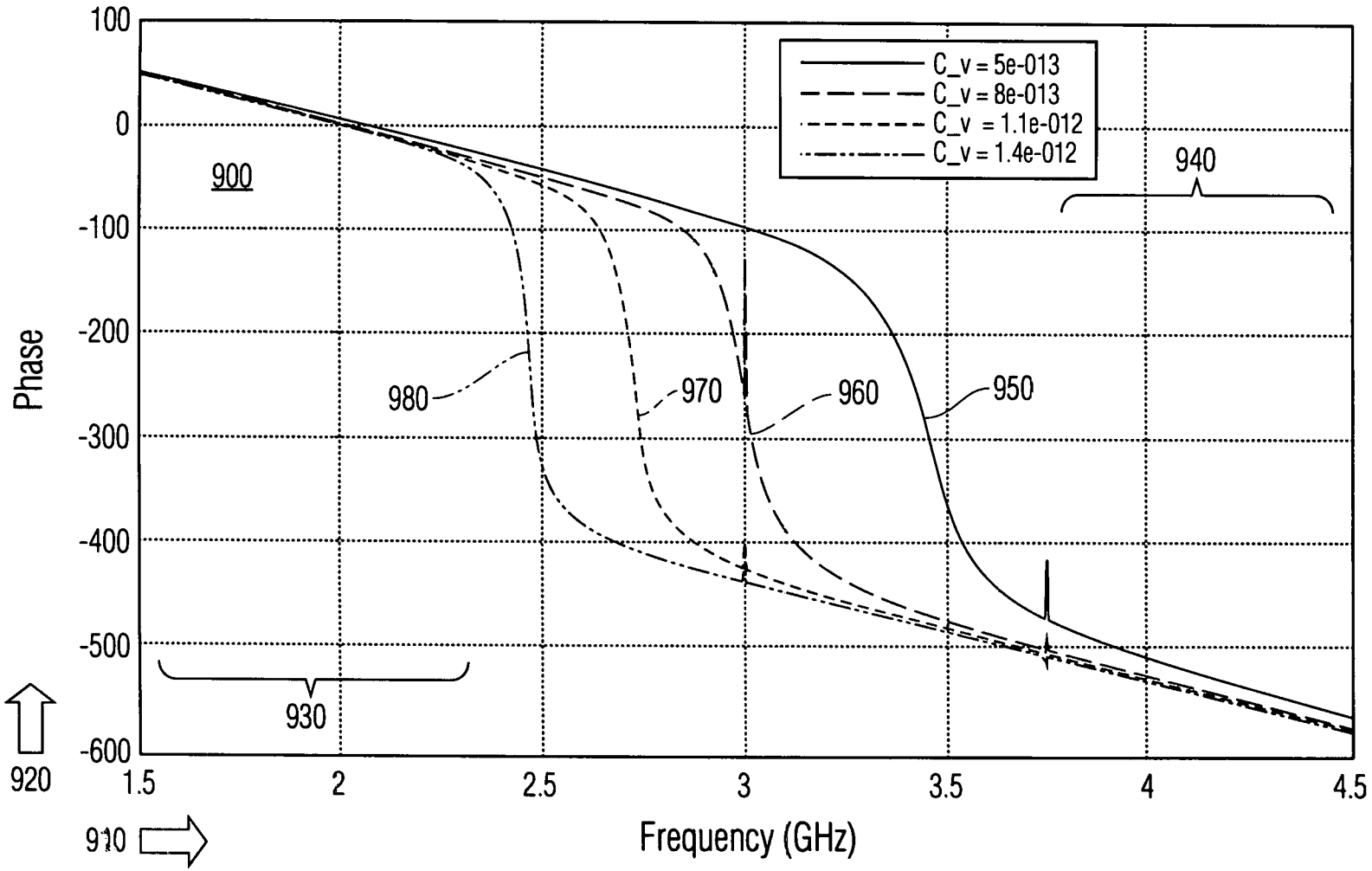
FIG. 9 is a plot view of phase response to frequency.

FIG. 9 shows a plot view 900 of phase shifts as a function of frequency between phases $\phi_1$ 850 and $\phi_2$ 860 for four different tuning states. The abscissa 910 denotes frequency in giga-hertz (GHz) and the ordinate 920 identifies phase response. The first and second phases $\phi_1$ and $\phi_2$ are respectively indicated for frequency domains at the lower portion 930 and the higher portion 940. For exemplary unit cell designs, tuning can be accomplished by any number of means including photo-capacitance, photo-dielectric effect, photo-capacitive ink, semiconductor junction effects (such as varactor, or photo-varactor diodes), piezoelectric materials include aluminum nitride (AlN), quartz (silicon oxide, $SiO_2$), gallium phosphate ($GaPO_4$), etc. or any other method. The lines 950, 960, 970, and 980 corresponds to the different capacities ($c_v$=0.5, 0.8, 1.1, and 1.4 pF) of the switching element in the unit cell.

Figure 10:
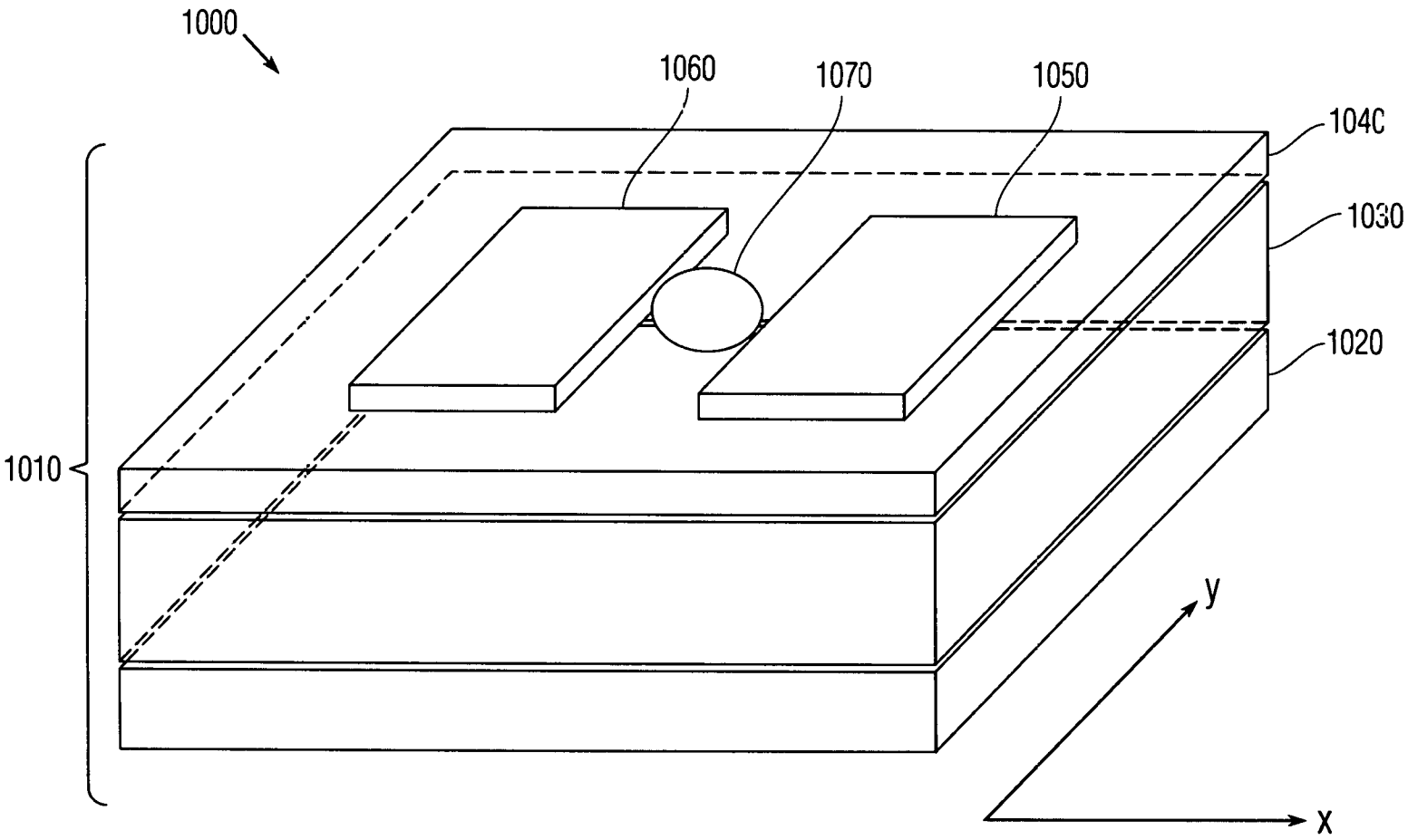
FIG. 10 is an isometric view of a unit cell disposable to form a planar reflective array.

FIG. 10 shows an isometric view 1000 showing structural detail of an exemplary unit cell 1010 analogous to unit-cell 720 illustrated schematically. The unit cell 1010 repeats itself in the x (horizontal) and y (vertical) directions to form a planar reflector array. Alternatively, two or more unit-cells 720 of different sizes layout side-by-side in the x-y plane to form a super cell 710, which repeats itself in the x and y directions to form a planar reflector array. The coordinates x (horizontal to right), y (diagonal to upper right) denote directions in the planes associated with the cell 1010. The structure includes a substrate that denotes a conductive backplane 1020 comprising for example copper (Cu), gold (Au), silver (Ag), aluminum (Al).

A dielectric layer 1030 can be formed by various materials, a FR-4 being a glass-reinforced laminate epoxy, which is low cost but lossy at high frequencies. For optical tuning, a light-guide film 1040 is disposed above the dielectric layer 1030. The film 1040 includes disposed thereon first and second (i.e., right-and-left) patch elements 1050 and 1060 joined together by a left switch element 1070.

That switch element 1070 can be formed from photo-capacitive ink. Alternatively, the switch element 1070 can be based on any of electric, optical, thermal, piezo, liquid crystal, phase transition material and micro-electromagnetic system (MEMS) configurations The switch element 1070 controls the state of the unit cell 1010, each of which has a pair of phase states. The design of the unit cell 1010 represents only one of many types that can be implemented. Other designs include but are not limited to cross structures, pad structures, mushroom structures in which a via ties some points of the pad to the ground plane, or inverses of the structures in which the non-metallic regions and metallic regions are reversed.

An advantage of exemplary embodiments is that the phase can be controlled with simple two-stage elements. Phase resolution depends on the number of elements while dynamic range in phase depends on the phase difference of the two states. Therefore, the resolution and the dynamic range can be independently controlled. A side lobe will exist since the system basically represents a two-element reflect-array where each element has different phases and amplitudes which can be controlled through, but not limited to, photocapacitors with different light intensities. Alternatively, one could use a microstrip semiconductor p-i-n diode phase shifter (with the high-level injection diode denoting positive-region, intrinsic-charge-carrying-type, negative-region). Side lobes can be minimized by controlling amplitude of the reflector elements in the same way to those skilled in the art with phased arrays.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An electromagnetic reflector for reflecting an electromagnetic signal based on phase, said reflector comprising:
- a first cell tuned to a first phase state;
- a second cell tuned to a second phase state, and
- a switch for selecting between said first and second cell,
- wherein the reflector contains a plurality of super-cells, each super-cell contains a plurality of unit cells, and each unit cell contains one of metallic elements and dielectric elements that form an effective resonant circuit.

2. The reflector according to claim 1, wherein said switch can be based on one of photo-capacitive ink, electric, optical, thermal, piezo, liquid crystal, phase transition material and MEMS configurations.

3. A method for controlling phase shift of a reflecting electromagnetic signal in a reflect-array antenna, said method comprising:
- providing photo-capacitive material in each unit cell to produce an optically controlled phase shift;
- providing varactors wherein electrically controlled phase shift occurs;
- providing metallic elements of metamaterial unit cells to enhance a phase shift;
- providing first and second cells, respectively tuned to first and second phase states; and
- adjusting the phase shift of the signal through selection of one of said first and second phase states.

* * * * *